US006487796B1

(12) United States Patent
Avar et al.

(10) Patent No.: US 6,487,796 B1
(45) Date of Patent: Dec. 3, 2002

(54) FOOTWEAR WITH LATERAL STABILIZING SOLE

(75) Inventors: Eric P. Avar, Aloha, OR (US); Thomas Foxen, Portland, OR (US); Craig E. Santos, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/754,022

(22) Filed: Jan. 2, 2001

(51) Int. Cl.[7] ..... A43B 13/18; A43B 5/00

(52) U.S. Cl. ..... 36/28; 36/35 R; 36/37; 36/114

(58) Field of Search ..... 36/28, 31, 27, 36/35 R, 37, 92, 88, 114

(56) References Cited

U.S. PATENT DOCUMENTS

| | | | | |
|---|---|---|---|---|
| 507,490 | A | | 10/1893 | Gambino |
| 607,086 | A | * | 7/1898 | Safford |
| 622,673 | A | | 4/1899 | Ferrata |
| 933,422 | A | | 9/1909 | Dee |
| 949,754 | A | | 2/1910 | Busky |
| 1,094,211 | A | | 4/1914 | Jenoi et al. |
| 1,099,180 | A | | 6/1914 | Karacsonyi |
| 1,102,343 | A | | 7/1914 | Kovacs |
| 1,272,490 | A | | 7/1918 | Matear |
| 1,278,320 | A | | 9/1918 | Ellithorpe |
| 1,338,817 | A | | 5/1920 | DeLuca |
| 1,502,087 | A | | 7/1924 | Bunns |
| 1,670,747 | A | | 5/1928 | Sestito |
| 1,870,065 | A | | 8/1932 | Nusser |
| 1,870,114 | A | | 8/1932 | Heller |
| 2,104,924 | A | | 1/1938 | Dellea |
| 2,122,108 | A | | 6/1938 | Modlin |
| 2,198,228 | A | * | 4/1940 | Pinaud et al. |
| 2,299,009 | A | | 10/1942 | Denk |
| 2,437,227 | A | | 3/1948 | Hall |
| 2,710,460 | A | | 6/1955 | Stasinos |

(List continued on next page.)

FOREIGN PATENT DOCUMENTS

| | | |
|---|---|---|
| CH | 570 130 | 9/1974 |
| DE | 806647 | 2/1949 |
| DE | 1485654 | 1/1965 |
| DE | 3400997 | 7/1985 |
| ES | 2080933 | 1/1990 |
| ES | 1036287 | 1/1997 |
| FR | 465267 | 4/1914 |
| FR | 1227420 | 4/1960 |
| FR | 2556118 | 6/1985 |
| GB | 21594 | of 1903 |
| GB | 7163 | 10/1906 |
| GB | 2 032 761 | 5/1980 |
| GB | 2 173 987 A | 10/1986 |
| JP | 146188 | 11/1990 |
| SU | 1526637 A1 | 12/1989 |

OTHER PUBLICATIONS

US 4,974,345, 12/1990, Yung-Mao (withdrawn)

Article entitled "Hoop Dreams".

Web page translation using babelfish, entitled "The tennis shoe with the motivating force".

(List continued on next page.)

*Primary Examiner*—M. D. Patterson
(74) *Attorney, Agent, or Firm*—Banner & Witcoff, Ltd.

(57) ABSTRACT

The invention is an article of footwear having a sole comprised of one or more support elements formed of a resilient, compressible material. The support elements are designed such that impact forces generated by movements of a wearer deflect the support elements in a manner that produces a force directed to center the wearer's foot above the sole. The directed deflection characteristics of the support elements are due to a downward cant of the support elements' upper surfaces and flexion indentations that facilitate bending in one direction.

50 Claims, 9 Drawing Sheets

U.S. PATENT DOCUMENTS 2,721,400 A 10/1955 Israel
3,041,746 A 7/1962 Rakus
3,429,545 A 2/1969 Michel
3,822,490 A 7/1974 Murawski
4,000,566 A * 1/1977 Famolare, Jr.
4,030,213 A 6/1977 Daswick
4,074,446 A 2/1978 Eisenberg
4,223,457 A 9/1980 Borgeas
4,237,625 A 12/1980 Cole et al.
4,241,523 A 12/1980 Daswick
4,262,433 A 4/1981 Hagg et al.
4,267,648 A 5/1981 Weisz
4,271,606 A 6/1981 Rudy
4,271,607 A 6/1981 Funck
4,314,413 A 2/1982 Dassler
4,319,412 A 3/1982 Muller et al.
4,342,158 A 8/1982 McMahon et al.
4,364,188 A 12/1982 Turner et al.
4,399,621 A 8/1983 Dassler
4,439,936 A 4/1984 Clarke et al.
4,492,046 A 1/1985 Kosova
4,494,321 A 1/1985 Lawlor
4,535,553 A 8/1985 Derderian
4,536,974 A 8/1985 Cohen
4,546,555 A 10/1985 Spademan
4,559,366 A 12/1985 Hostettler
4,566,206 A 1/1986 Weber
4,592,153 A 6/1986 Jacinto
4,594,799 A 6/1986 Lin
4,598,484 A 7/1986 Ma
4,598,487 A 7/1986 Misevich
4,610,099 A 9/1986 Signori
4,616,431 A 10/1986 Dassler
4,624,062 A 11/1986 Autry
4,638,575 A 1/1987 Illustrato
4,660,299 A 4/1987 Omilusik
4,680,875 A 7/1987 Danieli
4,680,876 A 7/1987 Peng
4,709,489 A * 12/1987 Welter
4,715,130 A 12/1987 Scatena
4,722,131 A 2/1988 Huang
4,731,939 A 3/1988 Parracho et al.
4,733,483 A 3/1988 Lin
4,746,555 A 5/1988 Luckanuck
4,753,021 A 6/1988 Cohen
4,774,774 A 10/1988 Allen, Jr.
D298,583 S 11/1988 Yung-Mao
4,794,707 A 1/1989 Franklin et al.
4,798,009 A 1/1989 Colonel et al.
4,802,289 A 2/1989 Guldager
4,815,221 A 3/1989 Diaz
4,843,737 A 7/1989 Vorderer
4,843,741 A 7/1989 Yung-Mao
4,845,863 A 7/1989 Yung-Mao
4,878,300 A 11/1989 Bogaty
4,881,328 A 11/1989 Yung-Mao
4,881,329 A 11/1989 Crowley
4,887,367 A 12/1989 Mackness et al.
4,905,382 A 3/1990 Lin
4,908,962 A 3/1990 Yung-Mao
4,910,884 A 3/1990 Lindh et al.
4,918,838 A 4/1990 Chang
4,936,029 A 6/1990 Rudy
4,956,927 A 9/1990 Misevich et al.
4,984,376 A 1/1991 Walter et al.
D315,634 S 3/1991 Yung-Mao
5,014,449 A 5/1991 Richard et al.
5,068,981 A 12/1991 Jung
5,092,060 A 3/1992 Frachey et al.
5,138,776 A 8/1992 Levin
5,222,312 A 6/1993 Doyle
5,233,767 A * 8/1993 Kramer
5,343,639 A 9/1994 Kilgore et al.
5,353,523 A 10/1994 Kilgore et al.
5,572,804 A 11/1996 Skaja et al.
5,685,090 A * 11/1997 Tawney et al.
5,782,014 A * 7/1998 Peterson
5,853,844 A * 12/1998 Wen
5,976,451 A 11/1999 Skaja et al.
6,018,889 A * 2/2000 Friton
6,055,747 A 5/2000 Lombardino
6,115,944 A * 9/2000 Lain
6,131,310 A * 10/2000 Fang
D433,216 S 11/2000 Avar et al.
6,233,846 B1 * 5/2001 Sordi
6,305,100 B1 * 10/2001 Komarnycky et al.

OTHER PUBLICATIONS

Elastocell™ Microcellular Polyurethane Procucts, Technical Information, Elastocell™, a Means for Antivibration and Sound Isolation.

Elastocell™ Microcellular Polyurethane Products, Material Data Technical Information, Long Term Static and Dynamic Loading of Elastocell®.

Elastocell™ Microcellular Polyurethane Products, Technical Bulletin, Spring and Damping Elements made from Elastocell.

Spring–and Shock Absorber Bearing Spring Elements, Springing Comfort with High Damping.

Activ Power Spring System catalog, front and back pages with English translation of back page.

Advertisement for Aura "Introducing the exciting new performance driven 2001 Aura."

FWN, vol. 40, No. 38, Sep. 17, 1990, "Marco Scatena puts spring in Athlon wearers' control".

SAE Technical Paper Series, "Microcellular Polyurethane Elastomers as Damping Elements in Automotive Suspension Systems," by Christoph Prolingheuer and P. Henrichs, International Congress and Exposition, Detroit, Michigan, Feb.25–Mar.1, 1991.

* cited by examiner

FOOTWEAR WITH LATERAL STABILIZING SOLE

TECHNICAL FIELD

The invention relates to footwear, more particularly to athletic shoes, wherein a cushioning sole is provided with a stability control device to enhance the stability of a wearer's foot, particularly during lateral motion. The sole includes a sole member which is compressible and resilient to thereby cushion foot impact, with the sole member having a stability control device that enhances lateral stability.

BACKGROUND OF THE INVENTION

Sole design for modem athletic footwear is generally characterized by a multi-layer construction comprised of an outsole, midsole, and insole. The midsole is typically composed of a soft, foam material to attenuate impact forces generated by contact of the footwear with the ground during athletic activities. Other prior art midsoles use fluid or gas-filled bladders of the type disclosed in U.S. Pat. Nos. 4,183,156 and 4,219,945 of Marion F. Rudy. Although foam materials succeed in providing cushioning for the foot, foam materials also impart instability that increases in proportion to midsole thickness. For this reason, footwear design often involves a balance of cushioning and stability.

The typical motion of the foot during running proceeds as follows. First, the heel strikes the ground, followed by the ball of the foot. As the heel leaves the ground, the foot rolls forward so that the toes make contact, and finally the entire foot leaves the ground to begin another cycle. During the time that the foot is in contact with the ground, it typically rolls from the outside or lateral side to the inside or medial side, a process called pronation. That is, normally, the outside of the heel strikes first and the toes on the inside of the foot leave the ground last. While the foot is air borne and preparing for another cycle the opposite process, called supination, occurs. Pronation, the inward roll of the foot in contact with the ground, although normal, can be a potential source of foot and leg injury, particularly if it is excessive. The use of soft cushioning materials in the midsole of running shoes, while providing protection against impact forces, can encourage instability of the sub-talar joint of the ankle, thereby contributing to the tendency for over-pronation. This instability has been cited as a contributor to "runners knee" and other athletic injuries.

Various methods for resisting excessive pronation or instability of the sub-talar joint have been proposed and incorporated into prior art athletic shoes as "stability" devices. In general, these devices have been fashioned by modifying conventional shoe components, such as the heel counter, by modifying the midsole cushioning materials or adding a pronation control device to a midsole. Examples of these techniques are found in U.S. Pat. Nos. 4,288,929; 4,354,318; 4,255,877; 4,287,675; 4,364,188; 4,364,189; 4,297,797; 4,445,283; and 5,247,742.

In addition to the control of pronation, another type of foot motion in athletics also places "stabilization" demands on athletic footwear. This type of motion is lateral, sideways or cutting movements which frequently happen in sports like basketball, volleyball, football, soccer and the like. An athlete in such athletics may be required to perform a variety of motions including movement to the side; quickly executed direction changes, stops, and starts; movement in a backwards direction; and jumping. While making such movements, footwear instability may lead to excessive inversion or eversion of the ankle joint, otherwise known as ankle sprain. For example, an athlete may be required to perform a rapid, lateral movement on a surface with friction characteristics that prevent sliding of the sole relative to the surface. Upon contact with the surface, the lateral portion of the foot impacts the interior of the footwear causing the lateral side of the midsole to compress substantially more than the medial side. The downward incline on the interior of the footwear caused by the differential compression, in conjunction with the momentum of the athlete's body, creates a situation wherein the shoe rolls towards the lateral side, causing an ankle sprain. Similar situations which cause excessive inversion or eversion comprise one of the most common types of injury associated with athletic activities. A shoe with high lateral (side-to-side) stability will minimize the effects of differential compression by returning to a condition of equilibrium—tending to center the foot over the sole.

The preceding example particularly arises when footwear incorporates a midsole with cushioning qualities that sacrifice stability. In order to compensate for this lack of stability, designers often incorporate devices into the upper that increase stiffness. These devices attempt to provide a stable upper to compensate for an instable sole. Such devices take the form of rigid members, elastic materials, or straps that add to the overall weight of the footwear, make the article of footwear cumbersome, or restrict plantar flexion and dorsi flexion. For example, U.S. Pat. No. 4,989,350 to Bunch et al. discloses an article of footwear with sheet springs attached to the ankle portion, and U.S. Pat. No. 5,152,082 to Culpepper discloses an ankle support including a plurality of stiff projections extending along the heel and ankle. U.S. Pat. No. 5,896,683 to Foxen et al. discloses a support in the form of a plurality of finger-like elements attached to the upper which does not add significant weight to the shoe and allows plantar and dorsi flexion.

U.S. Pat. No. 5,343,639 to Kilgore et al., which is hereby incorporated by reference, discloses an athletic shoe wherein a portion of the foam midsole is replaced with foam columns placed between a rigid upper and lower plate. FIGS. 1 and 2 depict this prior art shoe. As seen in FIG. 1, four support elements are incorporated in the midsole. Shoe 10 includes conventional upper 12 attached in a conventional manner to sole 14. Sole 14 includes midsole 18, and conventional outsole layer 20 formed of a conventional wear-resistant material such as a carbon-black rubber compound. Midsole 18 includes footframe 23, cushioning and stability component 24, midfoot wedge 40 and cushioning layer 22 made of a conventional cushioning material such as ethyl vinyl acetate (E.V.A.) or conventional non-microcellular polyurethane (PU) foam extending substantially throughout at least the forefoot portion of shoe 10.

Midsole 18 includes cushioning and stability component 24 extending rearwardly approximately from the forefoot to a location adjacent the posterior portion of cushioning layer 22. Cushioning and stability component 24 includes shell or envelope 26 having upper and lower plates 28 and 30, defining therebetween an open area of the sole, and a plurality of compliant elastomeric support elements 32 disposed in the open area. In a preferred embodiment of this prior art shoe, elements 32 have the shape of hollow, cylindrical columns or columns containing a plurality of interior voids. Furthermore, the columns of the prior art have flat upper surfaces, the upper surfaces being parallel with the outsole.

Shell 26 may be made from nylon or other suitable materials such as BP8929-2 RITEFLEX™, a polyester elastomer manufactured by Hoechst-Celanese of Chatham, N.J., or a combination of nylon having glass mixed therewith, for example, nylon with 13% glass. Other suitable materials would include materials having a moderate flexural modulus and exhibiting high resistance to flexural fatigue. Support elements 32 are made from a material comprising a microcellular polyurethane, for example, a microcellular polyurethane-elastomer based on a polyester-alcohol and naphthalene-1,5-diisocyanate (NDI), such as the elastomeric foam material manufactured and sold under the name ELASTOCELL™ by BASF Corporation. Other suitable polyurethane materials such as a microcellular polyurethane-elastomer based on a polyester-alcohol and methylenediphenylene-4,4'-diisocyanate (MDI) and a microcellular polyurethane-elastomer based on a polyester-alcohol and bitolyene (TODI) may be used. These materials exhibit a substantially uniform cell structure and small cell size as compared to the non-microcellular polyurethanes which have been used in prior art midsoles.

According to the '639 patent, utilization of microcellular polyurethanes has several advantages. For example, microcellular polyurethanes are more resilient than non-microcellular polyurethanes, thereby restoring more of the input energy imparted during impact. Furthermore, microcellular polyurethanes are more durable. This latter fact combined with the fact that the deflection of a foam column made from microcellular polyurethanes is more predictable than for non-microcellular polyurethanes allows the midsole to be constructed so as to selectively distribute and attenuate the impact load.

With reference to FIG. 2*a*, shell 26 includes upper and lower plates 28 and 30 which define an interior volume. Shell 26 serves to increase torsional rigidity about the anterior-posterior axis of the shoe. Additionally, shell 26 helps distribute the load between support elements 32, thereby controlling foot motion and providing stability. In FIG. 2*a*, upper and lower plates 28 and 30 are joined such that shell 26 has the shape of a generally closed oval envelope. This embodiment has the advantages of ensuring that all of the columns are loaded substantially axially during footstrike, and of providing a torsional restoring moment to upper plate 28 with respect to lower plate 30 when the foot is everted or inverted. Thus, stability is enhanced, making this embodiment particularly useful in running shoes. In addition, the closed envelope limits the load on the adhesives which secure support elements 32 to shell 26. Midfoot wedge 40 is disposed at the front of shell 26 and prevents total collapse of the shell structure at this region, which would cause a loss of midfoot support.

As depicted in FIGS. 2*b* and 2*c*, upper and lower plates 28 and 30 need not be joined and could take the form of unconnected upper and lower plates, or could be joined in only one portion, for example, the front or back.

Support elements 32 may have an overall hollow cylindrical shape and may have smooth exterior surfaces. Alternatively, the outer surface may include spaced grooves formed around the entire circumference on the exterior surface. Support elements 32 may be made from the elastomeric foam materials discussed above such as microcellular ELASTOCELL™ or other microcellular elastomeric materials having the same properties.

As shown in FIGS. 2*a*–2*c*, four support elements 32 may be disposed between the upper and lower plates. Elements 32 are generally disposed in a rectangular configuration, with a pair of anterior lateral and medial elements and a pair of posterior lateral and medial elements. Elements 32 are secured to the upper and lower plates by detents 34 and a suitable adhesive such as a solvent based urethane adhesive.

The use of microcellular as opposed to non-microcellular polyurethane foam for the columns allows for the gradual increase in stiffness to be obtained without having the stiffness be too great or small at the location of the initial impact.

Accordingly, it can be seen that a midsole according to the prior art included a plurality of hollow elements constructed from a microcellular foam material such as ELASTOCELL® NDI improves over the prior art non-microcellular polyurethane foams by providing a lower stiffness at the location of the initial impact which corresponds to lower initial loads, and a smooth transition to a much higher stiffness corresponding to the maximum load which is achieved beneath the calcaneus, with the higher load distributed throughout the rear of the midsole. In addition, the desired stiffness is achieved in a manner which avoids bottoming-out throughout the ground support phase, without increasing the weight and initial stiffness of the midsole beyond a desired level.

As noted, the prior art disclosed that the outer surface of support elements 32 may be escalloped to include a plurality of spaced grooves extending around the entire circumference of support elements 32. The use of an escalloped outer surface provides the advantage that large vertical compressions are facilitated by the pre-wrinkled shape, that is, the columns tend to be deflected more vertically. If the columns are designed with straight walls rather than escalloped walls, the tendency of the column to buckle is greater.

The present invention is directed to enhancing the lateral stability of shoes which use a cushioning and stability component of the type disclosed in the '639 patent.

SUMMARY OF THE INVENTION

The present invention relates to an article of footwear having an upper and a sole attached to the upper. The sole includes one or more support elements formed of a resilient, compressible material, and which are designed such that impact forces generated by movements of the wearer deflect the support elements in a manner producing a force directed to center the wearer's foot above the sole.

Directed deflection of the support elements is achieved by using a support element with a canted upper surface. Unlike the support elements as disclosed in the '639 patent that have a flat upper surface, the support elements of the present invention utilize an upper surface with a downward slope directed toward the interior of the footwear. In order achieve directed deflection, the support elements are arranged such that portions of the support elements on the exterior of the footwear have a greater elevation than portions on the interior of the footwear. When the support elements are located in the heel area, the heel of the wearer is positioned such that the periphery of the calcaneus is above portions of the support elements having lesser elevation. This arrangement ensures that the area of maximum stress is on the portion of the support element on the interior of the footwear, thereby causing the support elements to have a deflection bias in the inward direction.

Another aspect that adds to the directed deflection characteristics of the footwear are flexion indentations on the exterior of the support elements. In the '659 patent, indentations around the entire exterior surface. By placing indentations in only a selected portion of the exterior surface, the column will bend in the direction that the indentations are placed relative to the support element. As such, flexion indentations placed on portions of the support elements facing the interior of the footwear create a second mode of deflection bias in the support elements that also facilitates bending toward the interior of the footwear.

In a preferred embodiment, the article of footwear contains two forms of support elements, cylindrical columns and an aft support. Both the columns and aft support include a canted upper surface. However, only the columns include flexion indentations. The convex shape of the aft support element, in conjunction with a high aspect ratio of width to thickness, creates an inward deflection bias similar to that of the columns.

The article of footwear of the present invention may also contain a rigid heel plate for receiving the heel of the wearer. The outer surface of the heel plate includes locations for attaching to the upper surface of the support elements. The heel plate surrounds the bottom, medial, lateral, and aft portions of the heel, thereby countering excess movement. In addition, the rigid heel plate uniformly transfers impact forces from the heel to each individual support element.

The columns can be formed integral with a base portion formed of the same resilient, compressible material as the columns. A base plate formed of generally rigid material may also underlie the base portion and the support elements.

Together, these features form a system wherein movement of the wearer, including lateral movement, generates a force that tends to center the foot above the sole of the footwear. While the primary use for the system is in the heel area, the system can be used in other portions of the shoe, such as in the forefoot. As noted, the downward cant and flexion indentations create a deflection bias in the support elements. When the footwear comes into contact with the ground, the wearer's foot impacts the interior of the heel plate. The impact is then uniformly transferred through the rigid heel plate to the support elements. The deflection bias in the support elements tends to stabilize the heel plate and calcaneus above the sole. In a conventional article of footwear where the foam midsole has no deflection bias, the impact force will cause one area of the midsole to compress differentially from an opposite area. With the added momentum of the athlete's body, inversion or eversion may result. In contrast, the deflection bias of the present invention causes the support members to deflect toward the interior of the footwear, thereby enhancing lateral stability. As such, this system provides an article of footwear with high lateral stability.

DETAILED DESCRIPTION OF THE INVENTION

Figure 1:
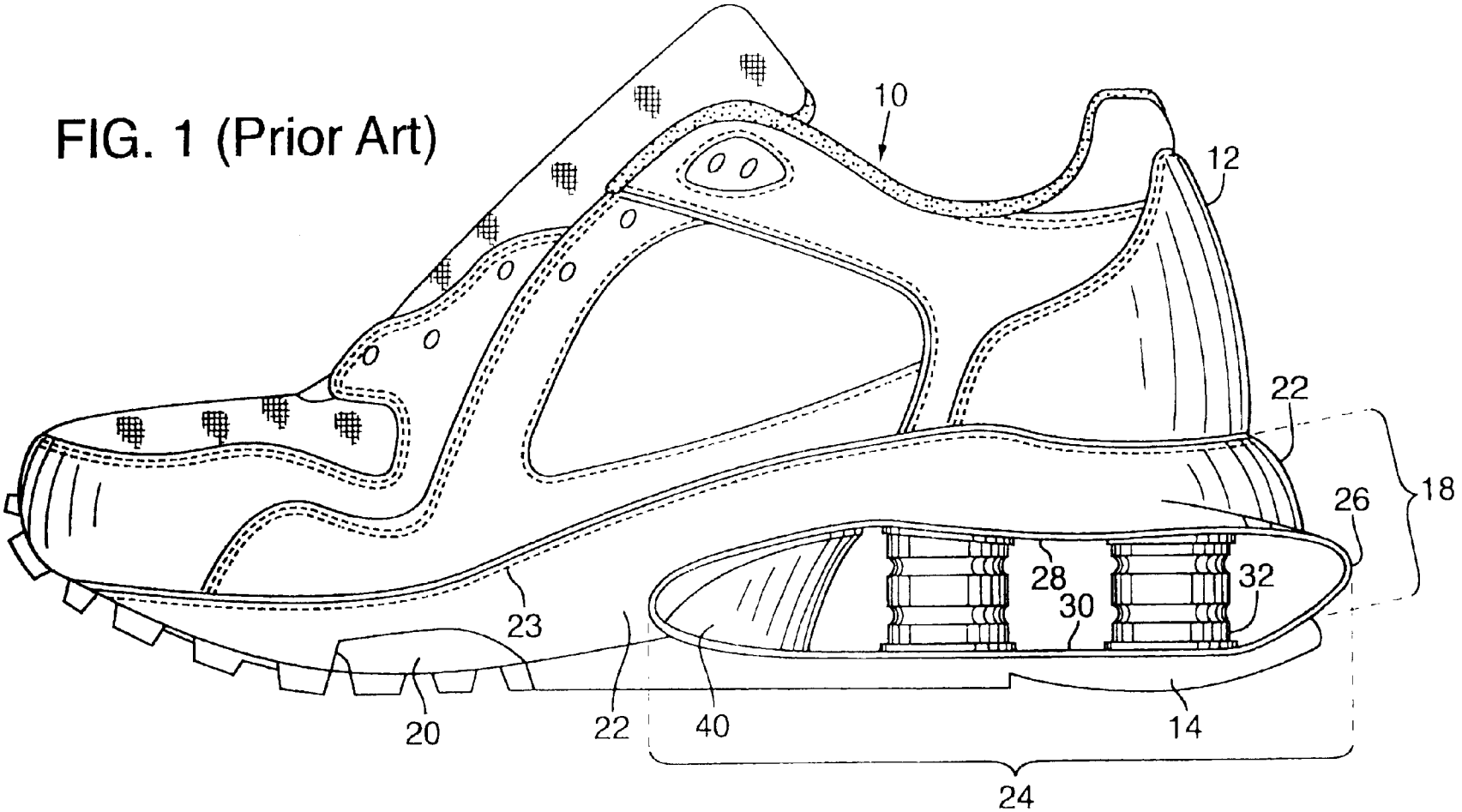
FIG. 1 (Prior Art)
FIG. 1 is a view of a shoe including a midsole according to a prior art invention.
Figure 2A:
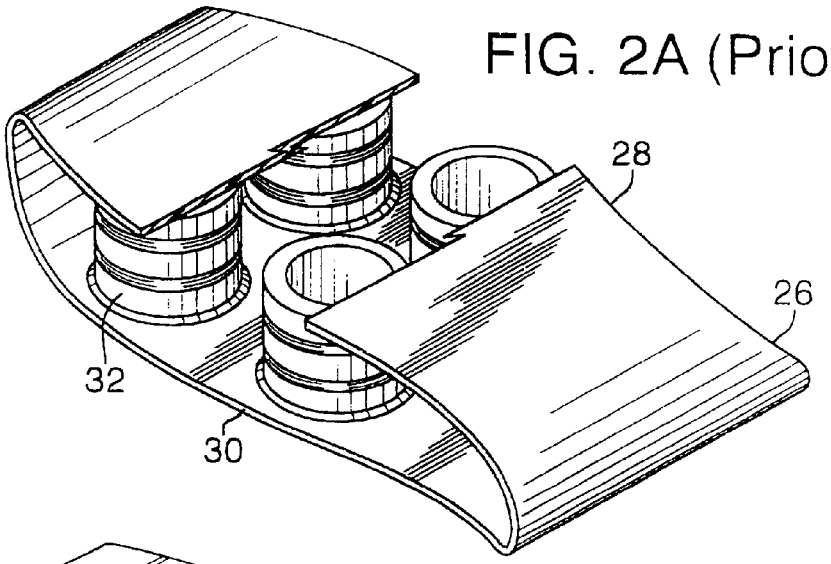
FIG. 2A (Prior Art)
FIGS. 2*a*–2*c* are perspective views of a cushioning and stability component according to the embodiments of a prior art invention.
Figure 2B:
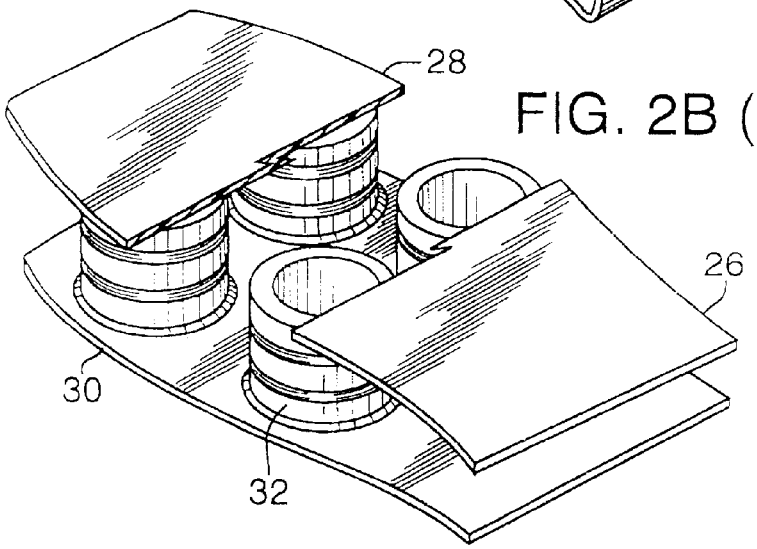
FIG. 2B (Prior Art)
Figure 2C:
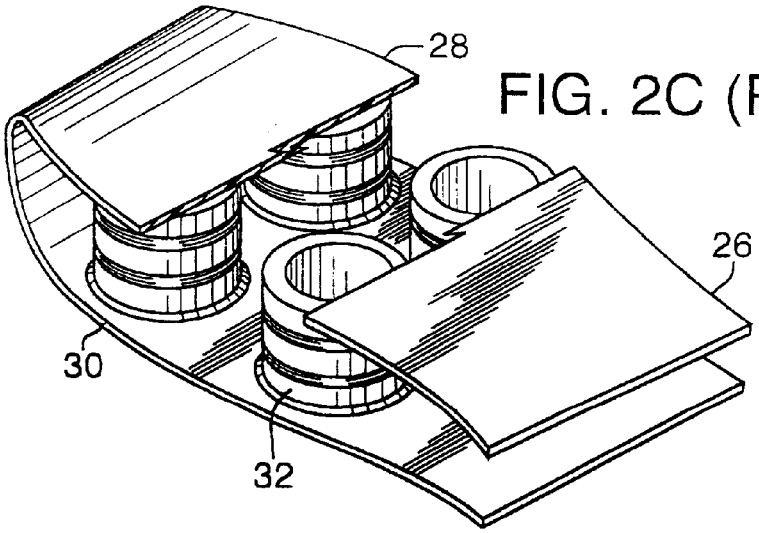
FIG. 2C (Prior Art)

Referring to the drawings, wherein like numerals indicate like elements, an article of footwear in accordance with the present invention is illustrated. The accompanying figures illustrate only the article of footwear intended for use on the left foot of a wearer. The preferred embodiment also includes a right article of footwear, such footwear being the mirror image of the left.

Figure 3:
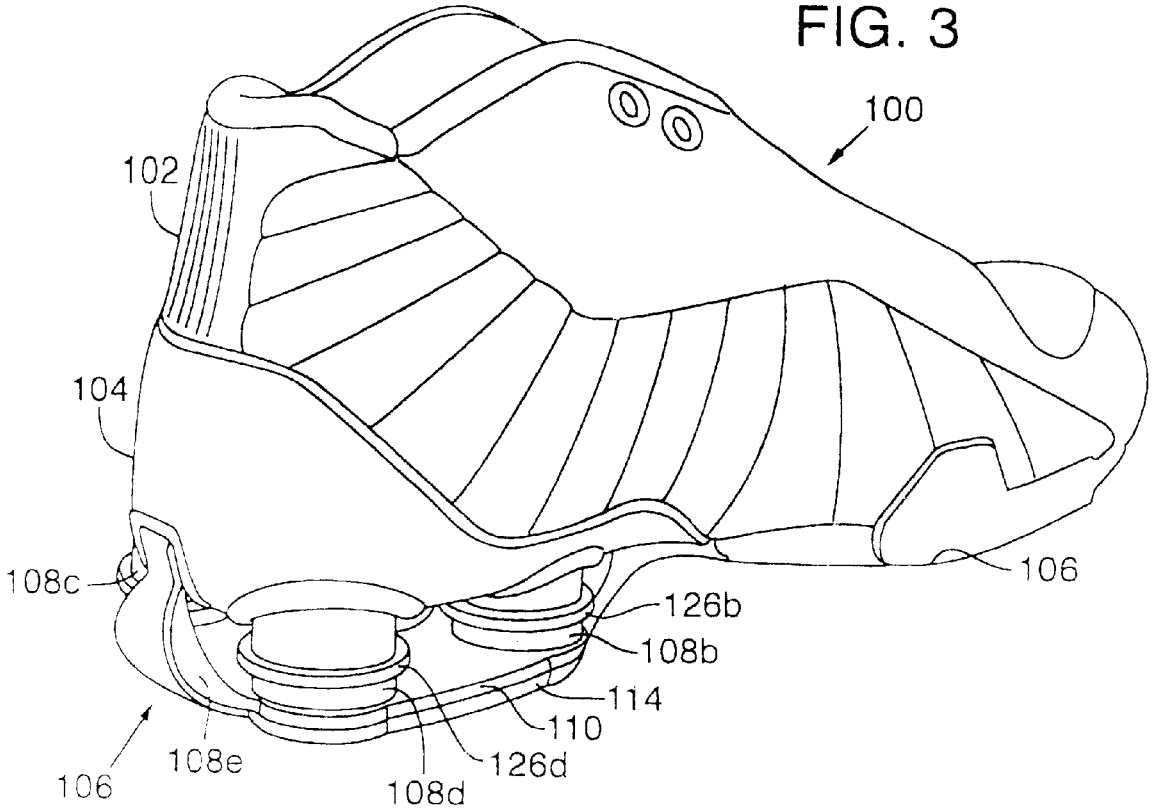
FIG. 3 is a medial and aft perspective view of a shoe according to the present invention.
Figure 4:
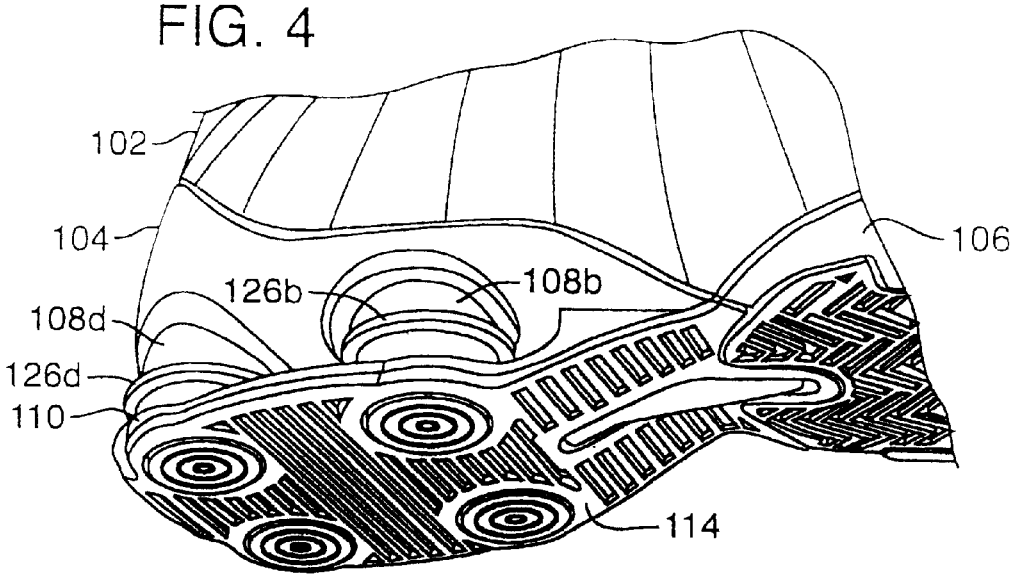
FIG. 4 is a medial and bottom perspective view of a shoe according to the present invention.
Figure 5:
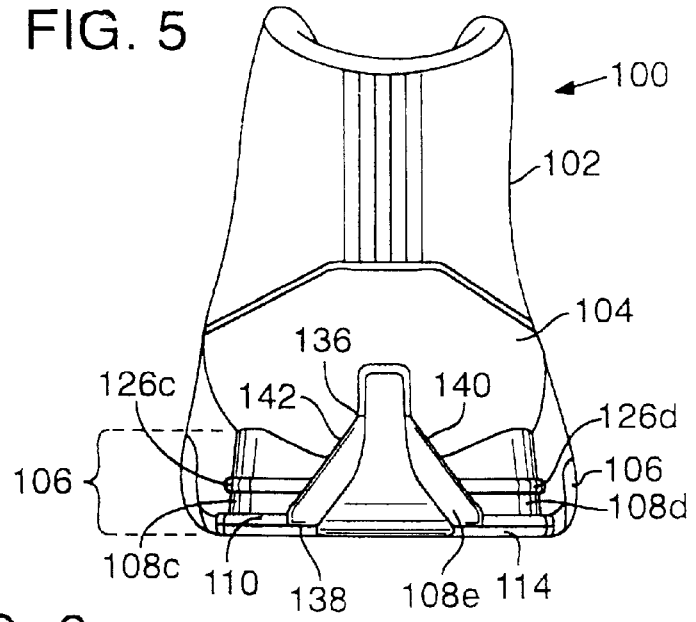
FIG. 5 is an aft view of a shoe according to the present invention.
Figure 6:
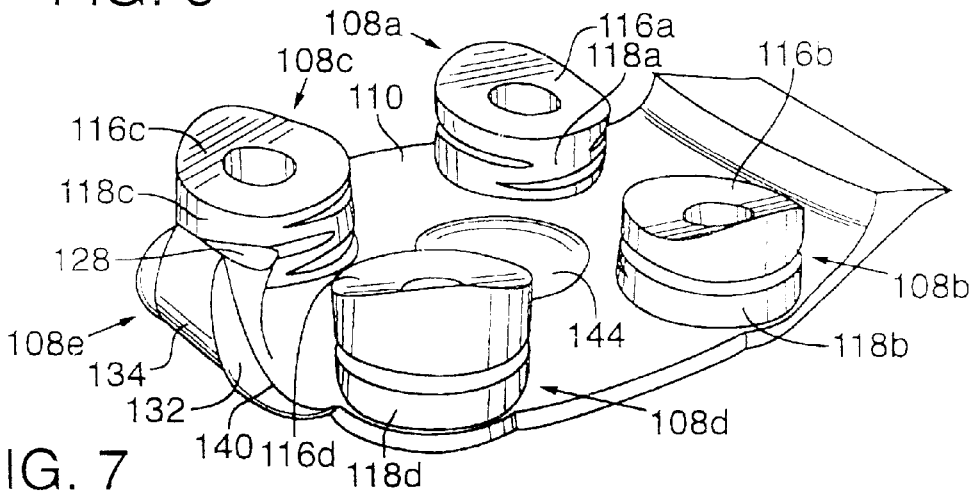
FIG. 6 is a perspective view of a stability component according to the present invention.
Figure 7:
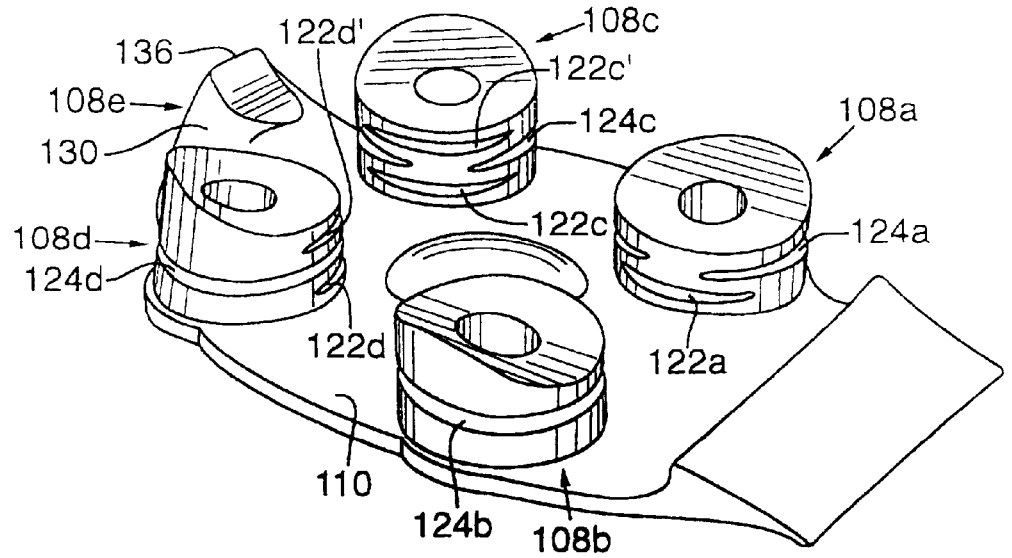
FIG. 7 is a second perspective view of a stability component shown in FIG. 6.
Figure 8:
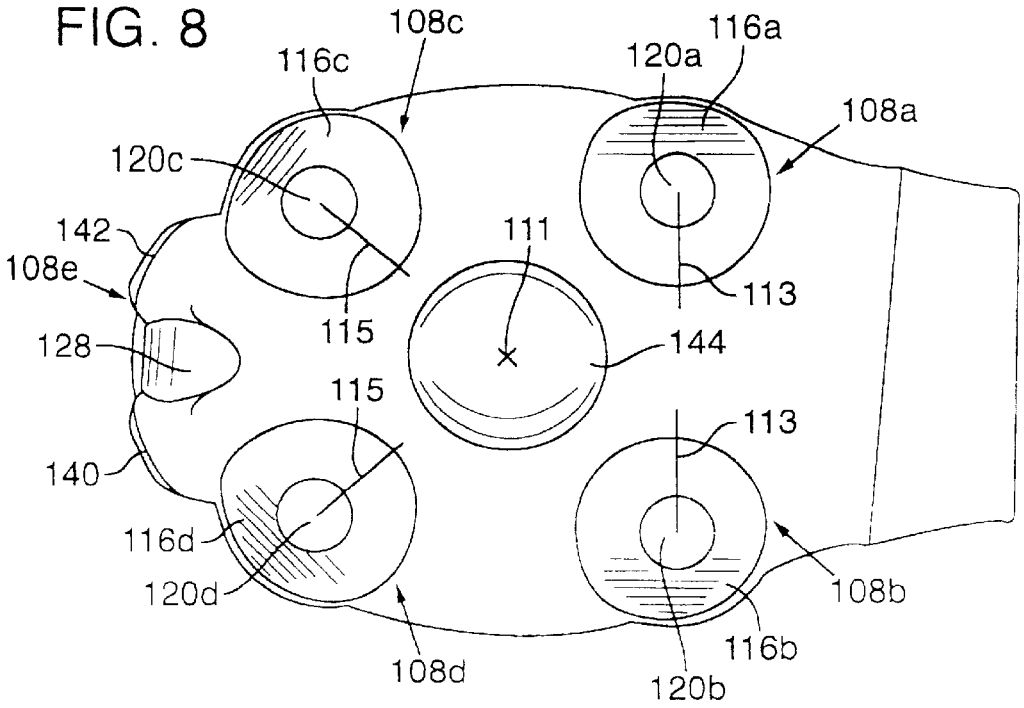
FIG. 8 is a top view of a stability component shown in FIG. 6.
Figure 9:
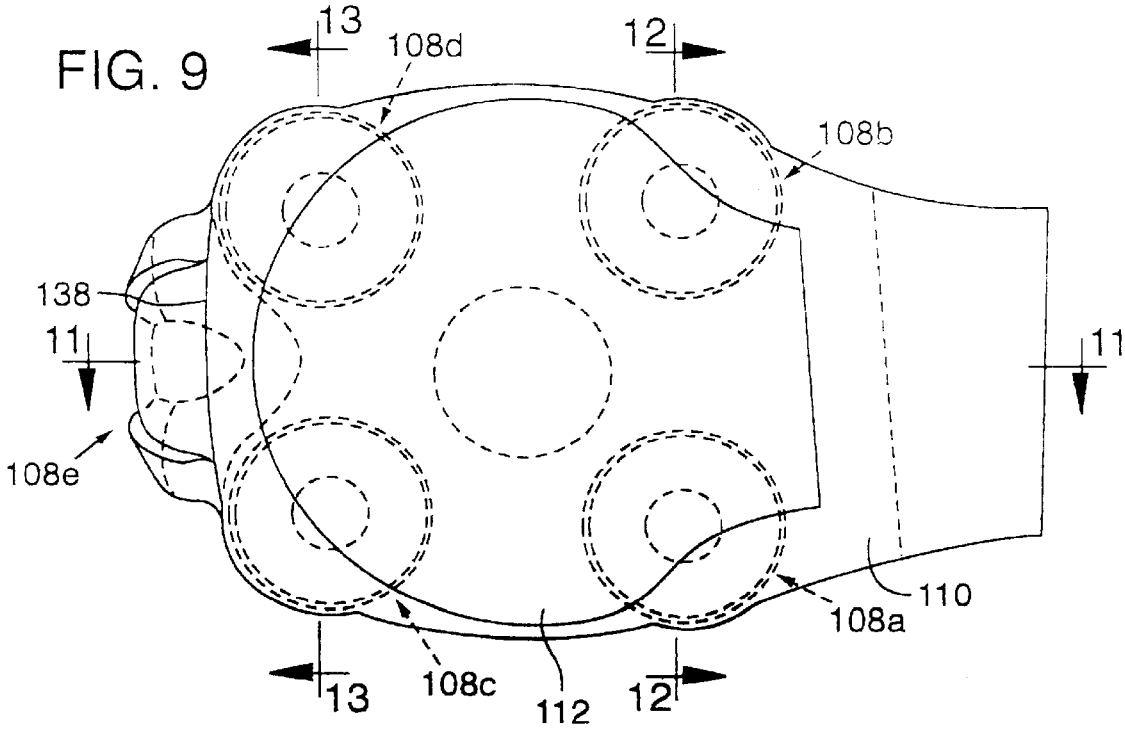
FIG. 9 schematically illustrates the bottom view of a stability component shown in FIG. 6.
Figure 10:
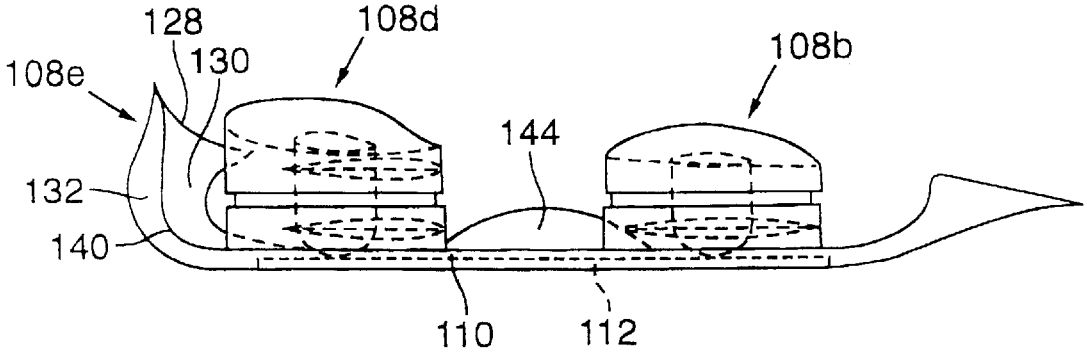
FIG. 10 schematically illustrates the side view of a stability component shown in FIG. 6.
Figure 11:
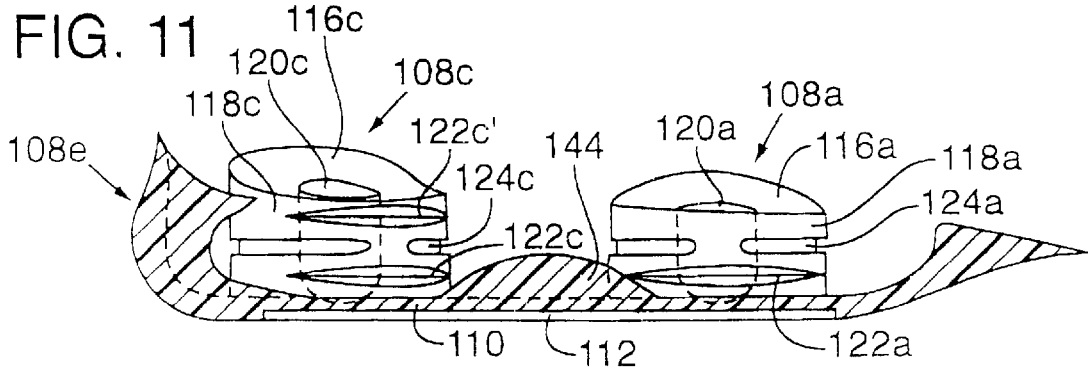
FIG. 11 is a cross-sectional view generally along line 11—11 of the stability component illustrated in FIG. 10.
Figure 12:
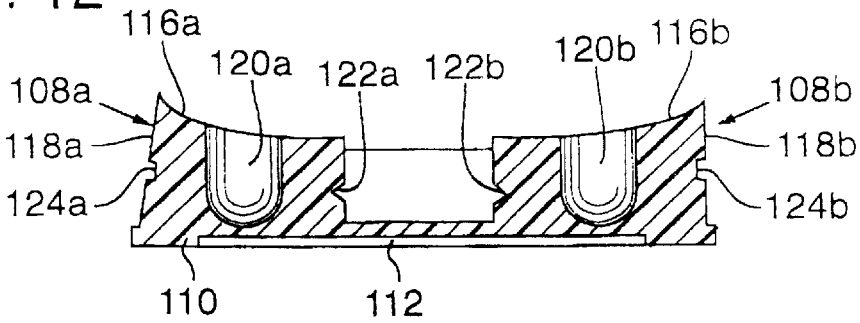
FIG. 12 is a cross-sectional view generally along line 12—12 of the stability component illustrated in FIG. 10.
Figure 13:
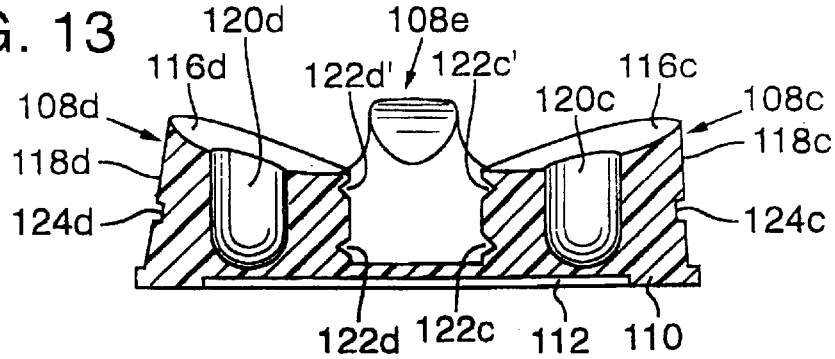
FIG. 13 is a cross-sectional view generally along line 13—13 of the stability component illustrated in FIG. 10.

With reference to FIGS. 3–5, a shoe including a sole according to the present invention is depicted. Shoe 100 includes three primary components: upper 102, heel plate 104, and sole 106. Sole 106 is further comprised of support elements 108, consisting of columns 108*a*–108*d* and aft support 108*e*, base 110, base plate 112 (not visible), and outsole 114. Upper 102 is attached to heel plate 104 in the aft portion of shoe 100 and outsole 114 in fore portions of shoe 100. Heel plate 104 is affixed to the upper surface of support elements 108. Underlying support elements 108, and formed integral therewith, is base 110. Located between base 110 and outsole 114 is base plate 112 as shown in FIG. 9. A cavity in sole 106 is defined by the space between heel plate 104 and base 110 that is not occupied by support elements 108.

FIGS. 6–13 depict support elements 108 and base 110 which are molded as a single component in the preferred embodiment. In alternate embodiments, support elements 108 may be formed independently of base 110 and then attached.

Columns 108*a*–108*d* are generally positioned with respect to an average foot structure for a given size of wearers of the footwear. As such, columns 108*a*–108*d* are generally positioned such that a midpoint 111 between the centers of columns 108*a*–108*d* generally corresponds with a point below the center of the calcaneus. Positioning is also such that no portion of columns 108*a*–108*d* are directly below the center of the calcaneus. Furthermore, individual column placement is as follows: column 108*a* is generally positioned on a lateral side of shoe 100 adjacent to a fore portion of the calcaneus; column 108*b* is generally positioned on a medial side of shoe 100 adjacent to a fore portion of the calcaneus; column 108*c* is generally positioned on a lateral side of shoe 100 adjacent to an aft portion of the calcaneus; and column 108*d* is generally positioned on a medial side of shoe 100 adjacent to an aft portion of the calcaneus.

Columns 108*a*–108*d* each have an upper surface 116, an external vertical surface 118, an interior void 120, one or more flexion indentations 122, and an o-ring indentation 124.

With respect to column 108*a*, upper surface 116*a* is defined by a downwardly-curving cant perpendicularly-directed toward a longitudinal centerline in the heel area, as shown by line 113. In the preferred embodiment, the slope of the downwardly-curving cant decreases to approximately zero as upper surface 116*a* approaches the longitudinal centerline. The decreasing slope defines a curvature on upper surface 116*a* with upper surface 116*a* being approximately horizontal adjacent to the interior of the cavity in sole 106.

Located on the central axis of column 108*a* and extending downward from upper surface 116*a* is a cylindrically-shaped interior void 120*a* extending throughout the height of column 108*a*, but not through base 110.

Flexion indentation 122*a* is a horizontal indentation in vertical surface 118*a* that extends around approximately one-third of the circumference of column 108*a*. The linear center of flexion indentation 122*a* is located on vertical surface 118*a* directly below the point of least elevation on upper surface 116*a*. As such, the linear center of flexion indentation 122*a* is located on the perpendicular line extending from the downward cant to the longitudinal centerline. With respect to vertical placement, flexion indentation 122*a* is located adjacent to the base of column 108*a*.

O-ring indentation 124*a* is a horizontal indentation in vertical surface 118*a* that extends around a majority of the circumference of column 108*a*. The area in the circumference of column 108*a* where o-ring indentation 124*a* is absent is centered generally above the linear center of flexion indentation 122*a*. The vertical positioning of o-ring indentation 124*a* is at an elevation approximately one-half the distance between flexion indentation 122*a* and upper surface 116*a* where upper surface 116*a* has the least elevation. Received in o-ring indentation 124*a* is o-ring 126*a* formed of a resilient elastic material and with a natural, unstretched or uncompressed diameter that is less than the diameter of column 108*a*.

Column 108*b* is the mirror image of column 108*a* as projected across the longitudinal centerline. Accordingly, the characteristics of column 108*b* are identical to that of column 108*a*, with the exception of nomenclature. Column 108*b* has upper surface 116*b*, exterior vertical surface 118*b*, interior void 120*b*, flexion indentation 122*b*, o-ring indentation 124*b*, and o-ring 126*b*.

With respect to column 108*c*, upper surface 116*c* is defined by a downwardly-curving cant directed toward the interior of shoe 100 and intersecting a longitudinal centerline in the heel at an angle of approximately 45 degrees, as shown by line 115. In the preferred embodiment, the slope of the downwardly-curving cant decreases to approximately zero as upper surface 116*c* approaches the longitudinal centerline along line 115. The decreasing slope defines a curvature on upper surface 116*c* with upper surface 116*c* being approximately horizontal adjacent to the interior of the cavity in sole 106.

Located on the central axis of column 108*c* and extending downward from upper surface 116*c* is a cylindrically-shaped interior void 120*c* extending throughout the height of column 108*c*, but not through base 110.

Flexion indentations 122*c* and 122*c*′ are horizontal indentations in vertical surface 118*c* that extend around approximately one-third of the circumference of column 108*c*. The linear centers of flexion indentations 122*c* and 122*c*′ are located on vertical surface 118*c* directly below the point of least elevation on upper surface 116*c*. As such, the linear centers of flexion indentations 122*c* and 122*c*′ are located on line 115. With respect to vertical placement, flexion indentation 122*c* is located adjacent to the base of column 108*c* and flexion indentation 122*c*′ is located adjacent to the upper surface 116*c* where upper surface 116*c* has the least elevation.

O-ring indentation 124*c* is a horizontal indentation in vertical surface 118*c* that extends around a majority of the circumference of column 108*c*. The area in the circumference of column 108*c* where o-ring indentation 124*c* is absent is centered generally between the linear centers of flexion indentations 122*c* and 122*c*′ . The vertical positioning of o-ring indentation 124*c* is at an elevation approximately one-half the distance between flexion indentation 122*c* and 122*c*′. Received in o-ring indentation 124*c* is o-ring 126*c* formed of a resilient, elastic material and with a natural, unstretched or uncompressed diameter that is less than the diameter of column 108*c*.

Column 108*d* is the mirror image of column 108*c* as projected across the longitudinal centerline. Accordingly, the characteristics of column 108*d* are identical to that of column 108*c*, with the exception of nomenclature. Column 108*d* has upper surface 116*d*, vertical surface 118*d*, interior void 120*d*, flexion indentation 122*d*, o-ring indentation 124*d*, and o-ring 126*d*.

With reference to FIGS. 9–13, base plate 112 is shown imbedded within an indentation in the lower surface of base 10. Preferably at least a portion of columns 108*a*–108*d* are located above base plate 112. The material comprising base plate 112 is preferably a short glass fiber reinforced nylon 6 or 66 with sufficient toughness to prevent piercing by objects on the ground.

Aft support 108*e* is located in the aft portion of shoe 100 on the centerline of the heel area of the sole. Aft support 108*e* has an upper surface 128, a fore surface 130, an aft surface 132, and an outsole indentation 134. Upper surface 128 is defined by a downwardly-curving cant directed toward the interior of shoe 100 that corresponds with the heel centerline. The slope of the downwardly-curving cant decreases to approximately zero as upper surface 128 approaches the fore surface 130. Fore surface 130 is a concave surface in the vertical direction that faces fore portions of shoe 100. Aft surface 132 has a general convex shape in the vertical direction that faces outwardly from shoe 100. As shown in FIG. 5, the boundaries of aft surface 132 are a parallel upper edge 136 and lower edge 138. In addition, medial edge 140 and lateral edge 142 are inclined inward such that upper edge 136 is of lesser length than lower edge 138. Additionally, the width of lower edge 138 is in the range of three to five times greater than the distance between fore surface 130 and aft surface 132.

Underlying and attached to base 110 and base plate 112 is outsole 114. An extension of outsole 114 wraps around aft surface 132 of aft support 108*e*, the extension fitting into, and attaching to, outsole indentation 134.

Located approximately at the intersection between lines connecting column 108*a* with column 108*d* and column 108*b* with column 108*c* is protrusion 144. Protrusion 144 is a convex portion of base 110 extending upward from the upper surface of base 110. If an impact force should be of a magnitude that excessively compresses support elements 108, heel plate 104 will contact protrusion 144, thereby preventing downward motion of heel 104 plate so as to contact base 110.

The preferred material for support elements 108, base 110, protrusion 144, and the support elements of alternate embodiments is an elastomer such as rubber, polyurethane foam, or microcellular foam having specific gravity of 0.63 to 0.67 g/cm$^3$, hardness of 70 to 76 on the Asker C scale, and stiffness of 110 to 130 kN/m at 60% compression. The material should also return 35 to 70% of energy in a drop ball rebound test, but energy return in the range of 55 to 65% is preferred. Furthermore, the material should have sufficient durability to maintain structural integrity when repeatedly compressed from 50 to 70% of natural height, for example, in excess of 500,000 cycles. Such a microcellular foam is also available by the HUNTSMAN POLYURETHANE'S Company of Belgium. Alternatively, a microcellular elastomeric foam of the type disclosed in U.S. Pat. No. 5,343,639 to Kilgore et al., which has been incorporated by reference and discussed in the Background of the Invention herein, may be used.

Figure 14:
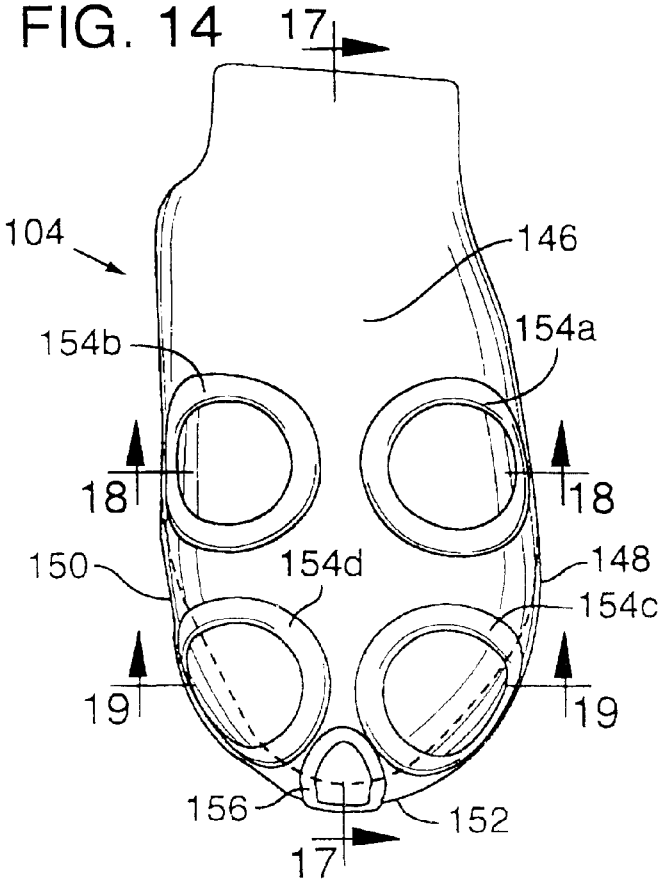
FIG. 14 is a bottom view of the heel plate of the present invention.
Figure 15:
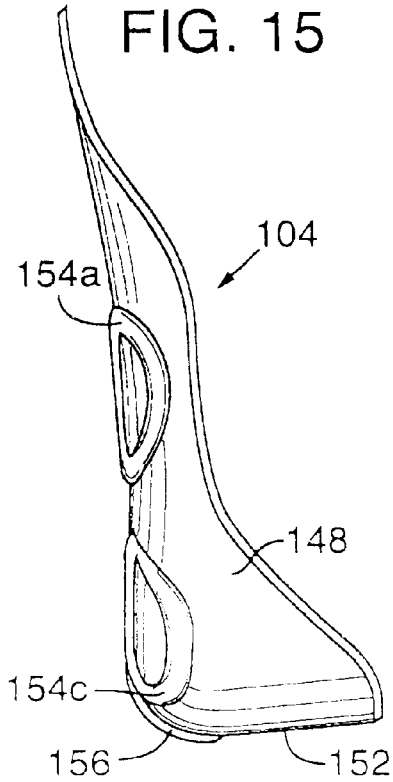
FIG. 15 is a lateral view of the heel plate shown in FIG. 14.
Figure 16:
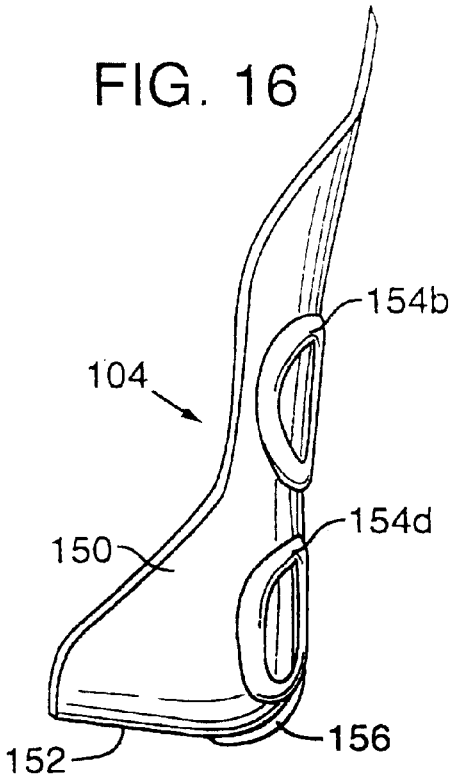
FIG. 16 is a medial view of the heel plate shown in FIG. 14.
Figure 17:
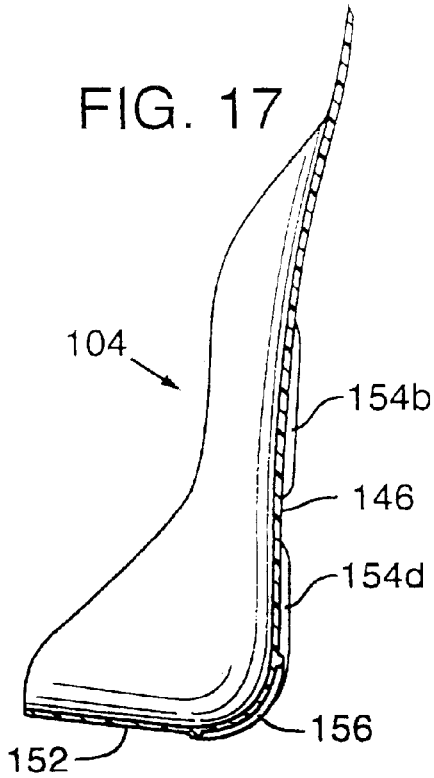
FIG. 17 is a cross-sectional view along line 17—17 of the heel plate illustrated in FIG. 14.
Figure 18:
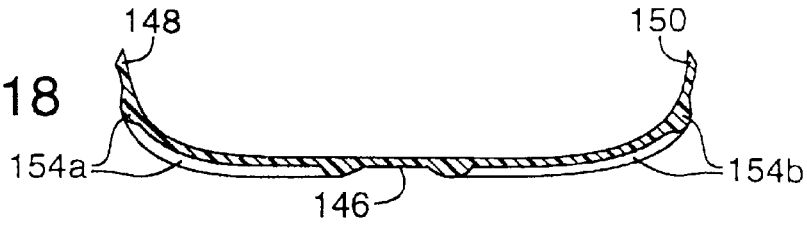
FIG. 18 is a cross-sectional view along line 18—18 of the heel plate illustrated in FIG. 14.
Figure 19:
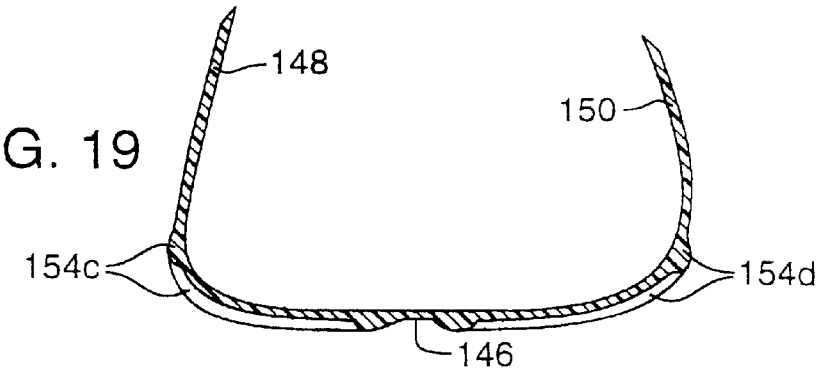
FIG. 19 is a cross-sectional view along line 19—19 of the heel plate illustrated in FIG. 14.

Heel plate 104 is depicted in FIGS. 14–19. Heel plate 104 is molded as a single, semi-rigid component that provides a foundation for aft portions of the wearer's foot and attaches to the upper surfaces of support elements 108. In combination, base portion 146, lateral side wall 148, medial side wall 150, and aft wall 152, form heel plate 104, and serve to counter lateral, medial, and rearward movement of the foot. Base portion 146 is depicted in FIG. 14 and extends from the plantar arch area of the wearer's foot to the plantar heel area. Lateral side wall 148 is shown in FIG. 15 and extends from central portions of the lateral arch area to the lateral heel area. Likewise, medial side wall 150, shown in FIG. 16, extends from central portions of the medial arch area to the medial heel area. The height of lateral side wall 148 and medial side wall 150 increase in the heel region where aft portions of the foot corresponding to the calcaneus are covered. Aft wall 152 bridges the gap between lateral side wall 148 and medial side wall 150, thereby covering the remainder of the aft calcaneus.

For purposes of receiving and attaching to upper surfaces 116 of columns 108*a*–108*d*, base portion 146 includes four raised, circular ridges 154. Raised aft support ridge 156 is positioned on a longitudinal centerline of base portion 146 that corresponds to section 17 of FIG. 14 and receives and attaches to upper surface 128 of aft support 108*e*. Circular ridges 154 and aft support ridge 148 define sites for receiving upper surfaces 116 and upper surface 128 that do not create protrusions on the interior surface of heel plate 104 that may cause discomfort to the wearer.

The preferred material for heel plate 104 must possess sufficient stiffness to distribute a downward force of a foot to columns 108*a*–108*d*, yet have sufficient compliance to bend downward between columns 108*a*–108*d*. One material having these characteristics is a polyether block copolyamide (PEBA) containing 50% short glass fiber. Such materials display a tensile strength of approximately 5671 psi and a flexural modulus of 492,292 psi. In order to achieve the necessary stiffness and compliance, base portion 146 of the preferred embodiment has a 1.25 mm thickness up to U.S. size 13 and a 1.50 mm thickness in U.S. sizes beyond 13.

The features expressed herein form a system that improves lateral stability by utilizing the movements of a wearer, including lateral movement, to center the wearer's foot above sole 106 of shoe 100. The primary stability device consists of the directed deflection characteristics of support elements 108. One such characteristic lies in the arrangement of columns 108*a*–108*e* such that portions on the exterior of shoe 100 have a greater elevation, due to canted upper surfaces 116, than portions on the interior. Heel plate 104 is then positioned such that the periphery of the calcaneus is above portions of columns 108*a*–108*d* having lesser elevation. This arrangement ensures that the area of maximum stress is on the portions of columns 108*a*–108*e* on the interior of shoe 100, thereby causing columns 108*a*–108*d* to have a deflection bias in the inward direction.

A second directed deflection characteristic of support elements 108 is the presence of flexion indentations 122 on vertical surfaces 118 of columns 108*a*–108*d* that correspond to the point of lowest elevation on upper surfaces 116. The placement of one or more flexion indentations 122 in this area causes bending of columns 108*a*–108*d* in the identical direction that canting of upper surfaces 118 facilitates. As such, canted upper surfaces 116 and flexion indentations 122 perform cooperatively to stabilize heel plate 104, and thereby the calcaneus of the wearer, above sole 106.

A third directed deflection characteristic of support elements 108 is present in aft support 108*e*. The ratio of the width of lower edge 138 to the distance between fore surface 130 and aft surface 132 is in the range of three to five. As such, aft support 108*e* prevents lateral shearing or bending stresses from acting to move heel plate 104 from the equilibrium position above sole 106.

Heel plate 104 surrounds the bottom, medial, lateral, and aft portions of the wearer's calcaneus, thereby countering independent movement of the heel relative to sole 106. When the wearer's motions create impact forces, heel plate 104 uniformly transfers the impact forces to each support element 108. As such, the deflection bias of support elements 108 interact to significantly prevent movement of heel plate 104 relative to sole 106.

As demonstrated, downwardly-canted upper surfaces 116 and flexion indentations 122 of columns 108*a*–108*d*; the design of aft support 108*e*; and the force transferring properties of heel plate 104 and base plate 112 creates a system that provides an article of footwear with high lateral stability. Since each portion of the system contributes to lateral stability, each portion can be used alone or in combination with other portions of the system.

Figure 20:
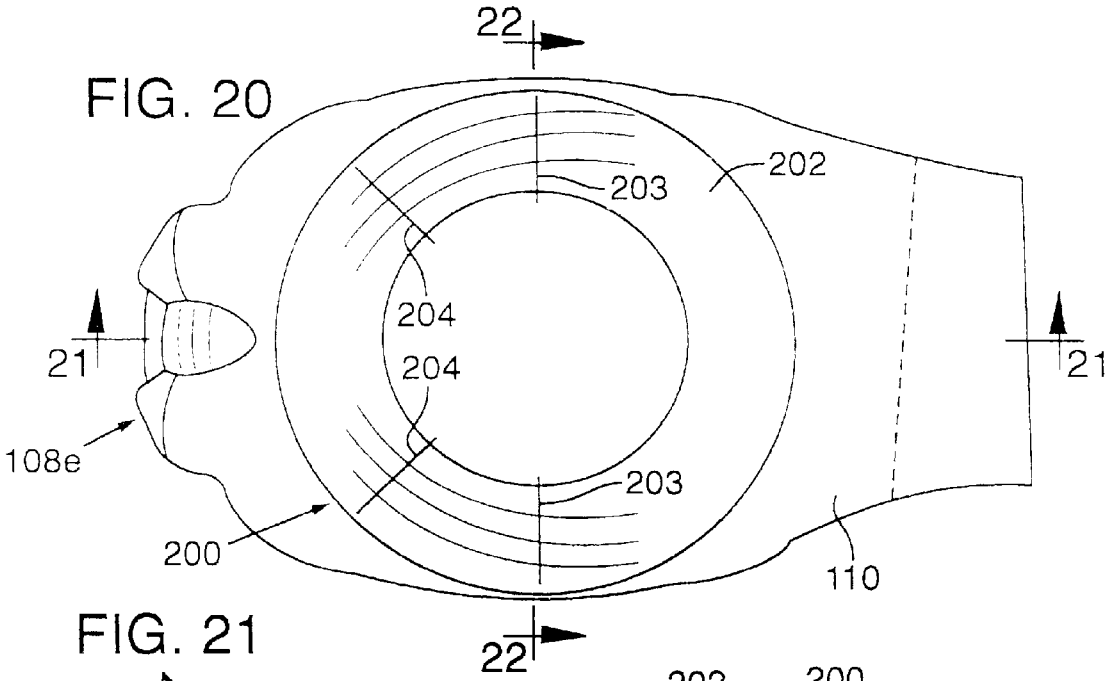
FIG. 20 is a top view of a stability component according to a first alternate embodiment of the present invention.
Figure 21:
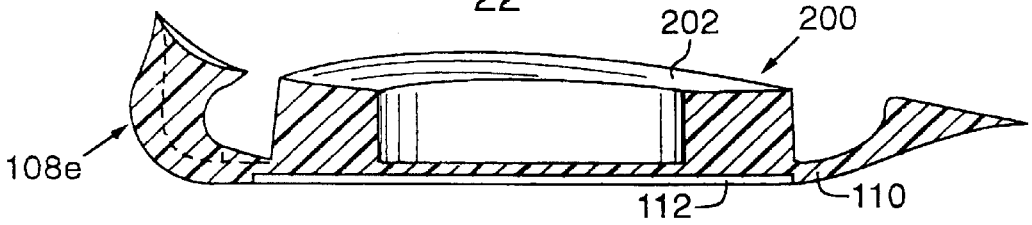
FIG. 21 is a cross-sectional view generally along line 21—21 of the alternate stability component illustrated in FIG. 20.
Figure 22:
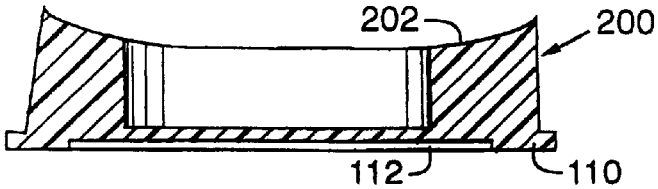
FIG. 22 is a cross-sectional view generally along line 22—22 of the alternate stability component illustrated in FIG. 20.

An alternate embodiment with substantially similar properties is depicted in FIGS. 20–22. In this embodiment, a single columnar support element 200 replaces columns 108*a*–108*d* of the preferred embodiment. Upper surface 202 of support element 200 is canted to provide stability. The lateral and medial regions of upper surface 202 include a downward cant as shown by lines 203 and 204 directed toward the center of support element 200. In the aft region, the canting of upper surface 202 is directed toward the center of support element 200. However, the canting slope in the aft region is less than that of the lateral and medial regions. In the fore region, upper surface 202 contains no cant and consists of a horizontal surface.

Figure 23:
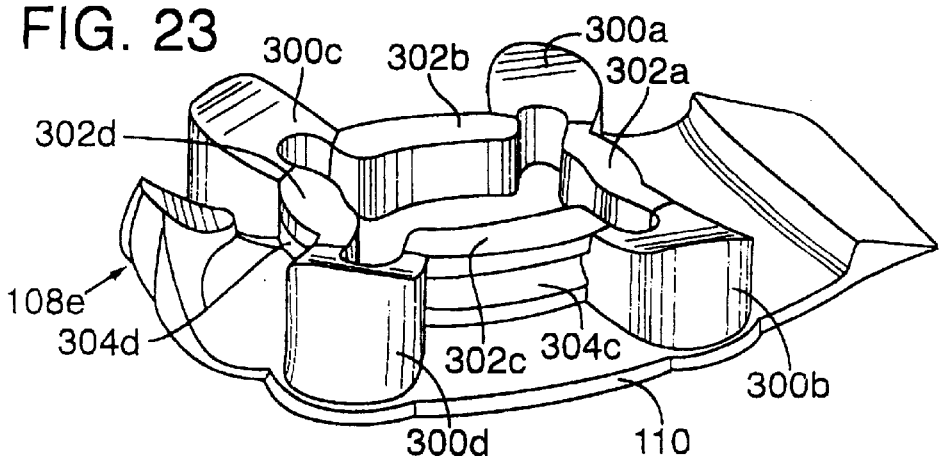
FIG. 23 is a perspective view of a stability component according to a second alternate embodiment of the present invention.
Figure 24:
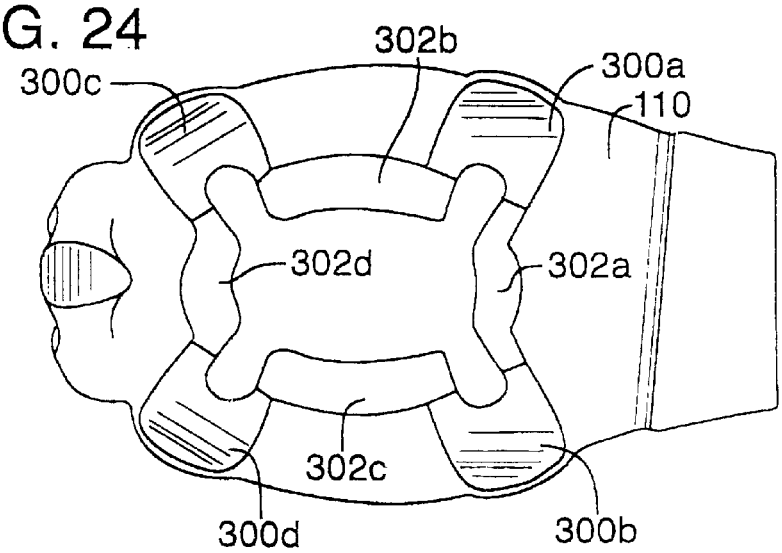
FIG. 24 is a top view of a stability component according to a second alternate embodiment of the invention.

Referring to FIGS. 23–24, a second alternative embodiment is depicted. Protruding from base 110 is a single columnar support element having external components 300 and connecting elements 302. Like columns 108*a*–108*d* of the preferred embodiment, external components 300 are canted such that the direction of downward cant in external component 300*a* and external component 300*b* is perpendicular to a longitudinal centerline of shoe 100. The downward cant in external component 300*c* and external component 300*d* is approximately directed at 45 degrees to the longitudinal centerline.

Linking external components 300 are four connecting elements 302. The elevation of the upper surface of connecting elements 302 is level with the point of least elevation in external components 300. The exterior surface of connecting elements 302 contains indentations 304 to improve compressibility.

In addition to the canted upper surfaces, materials with differing properties are utilized to achieve directed deflection characteristics. In order to ensure that deflections are properly directed and lend stability, external components 300 are formed of a material having a greater rigidity, density, and compressibility than the material used for connecting elements 302. The differing material properties permit greater compression on interior portions, thereby creating a deflection bias toward the center of shoe 100.

Figure 25:
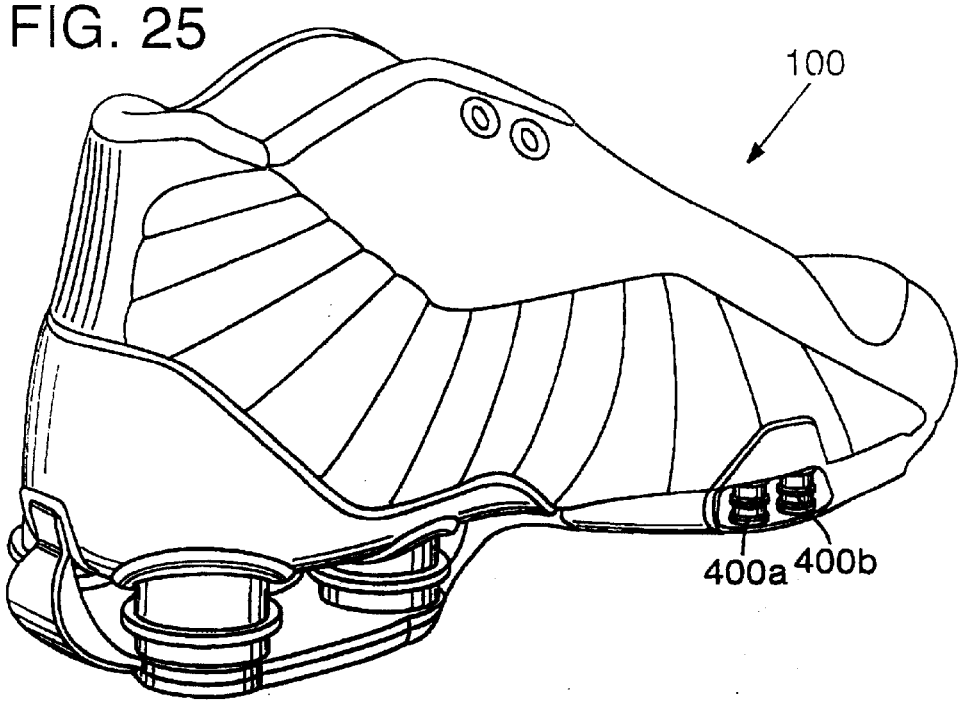
FIG. 25 is a medial view of a shoe including a sole according to a third alternate embodiment of the present invention.

FIG. 25 depicts an embodiment wherein support elements 400 are utilized in the forefoot region of shoe 100. Support elements 400 are fashioned from materials similar to that used in aft foot columns and possess a canted upper surface and flexion indentations which cause differential collapse or flexing toward the interior area of the sole in the forefoot region of shoe 100. Support elements 400 are scaled down to compensate for the reduced forces in the forefoot region and are preferably located on both the medial and lateral sides of shoe 100.

This invention has been disclosed with reference to the preferred embodiments. These embodiments, however, are merely for example only and the invention is not restricted thereto. It will be understood by those skilled in the art that other variations and modifications can easily be made within the scope of this invention as defined by the appended claims.

We claim:

1. An article of footwear having an upper for receiving a foot of a wearer and a sole attached to said upper, said sole comprising at least one support element having a columnar structure and containing an interior void, said at least one support element being formed of a first material and a second material that are resilient and compressible, said first material having a lesser stiffness than said second material, and said first material being located generally toward an interior portion of said sole with respect to said second material to structure said at least one support element such that impact forces generated by a downward or lateral movement of the foot deflects said at least one support element toward said interior portion of said sole.

2. The article of footwear of claim 1, wherein said sole includes a cavity located within a heel portion of said footwear, said cavity extending from a medial side to a lateral side of said footwear to define an open area extending through said sole, said at least one support element extending between upper and lower portions of said cavity to provide support for the foot in said heel portion of said footwear.

3. The article of footwear of claim 1, wherein an upper surface of said at least one support element includes a cant that defines a downward slope on said upper surface, said downward slope being dived toward said interior portion of said sole.

4. The article of footwear of claim 3, wherein said downward slope forms a downwardly-curved contour on said upper surface.

5. The article of footwear of claim 1, wherein an exterior surface of said at least one support element includes at least one flexion indentation located to promote deflection of said at least one support element toward said interior portion of said sole.

6. The article of footwear of claim 1, wherein said first material and said second material are microcellular foam materials.

7. The article of footwear of claim 1, wherein said sole includes a plurality of said at least one support element.

8. The article of footwear of claim 7, wherein said sole includes a semi-rigid heel plate generally located between said plurality of said at least one support element and a heel of the foot, said heel plate distributing impact forces from the heel to said plurality of said at least one support element.

9. An article of footwear having an upper for receiving a foot of a wearer and a sole attached to said upper, said sole comprising:

a cavity located within a heel portion of said footwear, said cavity extending from a medial side to a lateral side of said footwear to define an open area extending through said sole;

a plurality of discrete, vertically-projecting, columnar support elements located within said cavity and formed of a resilient and compressible material, said support elements extending between upper and lower portions of said cavity to provide support for the foot in said heel portion of said footwear, said support elements including at least one support element with an upper surface having a cant that defines a downward slope on said upper surface, said downward slope being directed toward an interior portion of said sole.

10. The article of footwear of claim 9, wherein said downward slope forms a downwardly-curved contour on said upper surface.

11. The article of footwear of claim 9, wherein said support elements have a cylindrical configuration.

12. The article of footwear of claim 9, wherein an exterior surface of said at least one support element includes at least one flexion indentation located to promote deflection of said at least one Support element toward said interior portion of said sole.

13. The article of footwear of claim 9, wherein said support elements include interior voids.

14. The article of footwear of claim 9, wherein said at least one support element is formed of a first material and a second material, said first material having a lesser stiffness than said second material, and said first material being located generally toward said interior of said sole with respect to said second material.

15. The article of footwear of claim 9, wherein said support elements are formed of a microcellular foam material.

16. The article of footwear of claim 9, wherein said heel plate underlies at least a portion of an arch of the foot and substantially all of the heel.

17. The article of footwear of claim 9, wherein said sole includes a base plate located between said support elements and an outsole.

18. The article of footwear of claim 9, wherein said at least one support element includes:

a first support element positioned in an aft area of said heel portion and on said lateral side of said footwear;

a second support element positioned forward of said first support element;

a third support element positioned in said aft area of said heel portion and on said medial side of said footwear; and a fourth support element positioned forward of said third support element.

19. The article of footwear of claim 18, wherein said first, second, third, and fourth support elements have a columnar structure.

20. The article of footwear of claim 18, wherein each of said first, second, third, and fourth support elements include upper surfaces with cants that define downward slopes on said upper surfaces, said downward slopes being directed toward said interior portion of said sole.

21. The article of footwear of claim 20, wherein said downward slope of said second support element and said downward slope of said fourth support element are directed approximately perpendicular to a longitudinal axis of said footwear.

22. The article of footwear of claim 21, wherein said downward slope of said first support element and said downward slope of said third support element have directions that form acute angles with respect to said longitudinal axis.

23. The article of footwear of claim 18, wherein a midpoint of locations of said plurality of said support element generally corresponds with a point located below a center of a calcaneus of the foot.

24. The article of footwear of claim 18, wherein said plurality of said support element are generally located adjacent a calcaneus of the foot, with no portion of said plurality of said support element being located below a center of the calcaneus.

25. The article of footwear of claim 9, wherein said footwear includes a plurality of forefoot support elements located in a forefoot portion of said sole.

26. An article of footwear having an upper for receiving a foot of a wearer and a sole attached to said upper, said sole comprising:

a cavity located within a heel portion of said footwear, said cavity extending from a medial side to a lateral side of said footwear to define an open area extending through said sole; and a plurality of discrete, vertically-projecting support elements located within said cavity and formed of a resilient and compressible material, said support elements extending between upper and lower portions of said cavity to provide support for the foot in said heel portion of said footwear, said support elements including at least one support element with an exterior surface that defines at least one flexion indentation that extends partially around said at least one support element and faces an interior portion of said footwear, and said at least one support element bending in response to a downward force from the foot, said bending being directed toward said at least one flexion indentation.

27. The article of footwear of claim 26, wherein an upper surface of said at least one support element includes a cant that defines a downward slope on said upper surface, said downward slope being directed toward an interior portion of said sole.

28. The article of footwear of claim 27, wherein said downward slope forms a downwardly-curved contour on said upper surface.

29. The article of footwear of claim 26, wherein said sole includes four of said support elements.

30. The article of footwear of claim 26, wherein said sole includes a semi-rigid heel plate generally located between a heel of the foot and said support elements, said heel plate distributing impact forces from the heel to said support elements.

31. The article of footwear of claim 30, wherein said heel plate underlies at least a portion of an arch of the foot and substantially all of the heel.

32. The article of footwear of claim 26, wherein said sole includes a base plate located between said support elements and an outsole.

33. The article of footwear of claim 26, wherein said support elements each include an interior void.

34. An article of footwear having an upper for receiving a foot of a wearer and a sole attached to said upper, said sole comprising:

a cavity located within a heel portion of said footwear, said cavity extending from a medial side to a lateral side of said footwear to define an open area extending through said sole; and a plurality of discrete, vertically-projecting, columnar support elements located within said cavity and formed of a resilient and compressible material, said support elements extending between upper and lower portions of said cavity to provide support for the foot in said heel portion of said footwear, at least one of said support elements having an upper surface with a cant that defines a downward slopes on said upper surface, said downward slope being directed toward an interior portion of said sole, and said at least one of said support elements having an exterior surface with a flexion indentation that promotes deflection of said at least one of said support elements toward said interior portion of said sole.

35. The article of footwear of claim 34, wherein said downward slope forms a downwardly-curved contour on said upper surface.

36. The article of footwear of claim 34, wherein said support elements include:

a first support element positioned in an aft area of said heel portion and on said lateral side of said footwear;

a second support element positioned forward of said first support element;

a third support element positioned in said aft area of said heel portion and on said medial side of said footwear; and a fourth support element positioned forward of said third support element.

37. The article of footwear of claim 36, wherein said downward slope of said second said support element and said downward slope of said fourth said support element are directed approximately perpendicular to a longitudinal axis of said footwear.

38. The article of footwear of claim 37, wherein said downward slope of said first said support element and said downward slope of said third said support element have a direction that forms acute angles with respect to said longitudinal axis.

39. The article of footwear of claim 34, wherein said support elements have a cylindrical configuration.

40. The article of footwear of claim 34, wherein said support elements are formed of a microcellular foam material.

41. The article of footwear of claim 34, wherein said sole includes a semi-rigid heel plate generally located between said support elements and a heel of the foot, said heel plate distributing impact forces from the heel to said support elements.

42. An article of footwear having an upper for receiving a foot of a wearer and a sole attached to said upper, said sole comprising:

a cavity located within a heel portion of said footwear, said cavity extending from a medial side to a lateral side of said footwear to define an open area extending through said sole; and four discrete, vertically-projecting, columnar support elements located within said cavity and formed of a resilient and compressible material, said support elements including:

a first support element positioned in an aft area of said heel portion and on said lateral side of said footwear, a second support element positioned forward of said first support element, a third support element positioned in said aft area of said heel portion and on said medial side of said footwear, and a fourth support element positioned forward of said third support element, said support elements extending between upper and lower portions of said cavity to provide support for the foot in said heel portion of said footwear, upper surfaces of said support elements including cants to define downward slopes on said upper surfaces, said downward slopes being directed toward an interior portion of said sole.

43. The article of footwear of claim 42, wherein said downward slope of said second support element and said downward slope of said fourth support element are directed approximately perpendicular to a longitudinal axis of said footwear.

44. The article of footwear of claim 43, wherein said downward slope of said first support element and said downward slope of said third support element have directions that form acute angles with respect to said longitudinal axis.

45. The article of footwear of claim 42, wherein a midpoint of locations of said support elements generally corresponds with a point located below a center of a calcaneus of the foot.

46. The article of footwear of claim 42, wherein said support elements are generally located adjacent a calcaneus of the foot, with no portion of said support elements being located below a center of the calcaneus.

47. The article of footwear of claim 42, wherein said downward slopes form downwardly-curved contours on said upper surfaces.

48. The article of footwear of claim 42, wherein said support elements have a cylindrical configuration.

49. The article of footwear of claim 42, wherein an exterior surface of at least one said support element includes a flexion indentation that promotes deflection of said at least one support element toward said interior portion of said sole.

50. The article of footwear of claim 42, wherein said support element includes an interior void.

* * * * *